US006010185A

United States Patent [19]

Petersen

[11] Patent Number: 6,010,185

[45] Date of Patent: Jan. 4, 2000

[54] PICNIC TABLE

[76] Inventor: Chris C. Petersen, 1523 1st Ave. South, Denison, Iowa 51442

[21] Appl. No.: 09/231,482

[22] Filed: Jan. 14, 1999

[51] Int. Cl.[7] ..... A47C 83/02

[52] U.S. Cl. ..... 297/158.3; 297/157.1; 297/158.5; D6/337

[58] Field of Search ..... 297/158.3, 157.1, 297/158.5; 108/180, 153.1; D6/337

[56] References Cited

U.S. PATENT DOCUMENTS

| | | | |
|---|---|---|---|
| D. 396,356 | 7/1998 | Petersen | D6/337 |
| 681,394 | 8/1901 | Hile | 297/157.1 |
| 3,120,405 | 2/1964 | Soszynski | 297/158.3 |
| 5,720,512 | 2/1998 | Hostetler | 297/158.3 X |
| 5,782,526 | 7/1998 | Ott | 297/158.5 X |

FOREIGN PATENT DOCUMENTS

| | | | |
|---|---|---|---|
| 621185 | 4/1949 | United Kingdom | 297/158.3 |

OTHER PUBLICATIONS

Petersen "Precast Site Furnishings" Brochure, pp. 8–13, Undated.

Upbeat Incorporated "Fall/Winter '98 Institutional Catalog", pp. 67–76.

*Primary Examiner*—Peter M. Cuomo
*Assistant Examiner*—Rodney B. White
*Attorney, Agent, or Firm*—Zarley, McKee, Thomte Voorhees & Sease; Dennis L. Thomte

[57] ABSTRACT

A picnic table comprising a table top having a square tube removably secured to the underside which extends downwardly therefrom. A pair of detachable legs are secured to opposite sides of the square tube and a pair of non-detachable legs are secured to the other sides of the square tube. Each of the legs has a seat support extending upwardly from the outer end thereof. Seats are detachably secured to the seat supports.

15 Claims, 3 Drawing Sheets

PICNIC TABLE

BACKGROUND OF THE INVENTION

1. Field of the Invention

This invention relates to a picnic table and more particularly to a picnic table comprised of metal and plastic and which may be shipped in an unassembled condition and easily assembled at the point of use.

2. Description of the Related Art

Many types of picnic tables have been previously described and a vast majority of the same have been constructed of wood, plastic, concrete, etc. The concrete picnic tables, while extremely durable, are not easily shipped from the manufacturing facility to the point of use due to the size and weight thereof. Picnic tables have also been comprised of a plastic material, but those tables, while having met with considerable success, are not easily shipped and do not have the weight or stability of concrete tables or tables including metal component parts. Picnic tables have also been previously provided which include a metal supporting frame having seats and a table top secured thereto, but those picnic tables are normally too large to ship by United Parcel Service or the like.

SUMMARY OF THE INVENTION

A picnic table is disclosed which is comprised of a metal leg assembly and a metal seat support structure with the seats and table top of the picnic table being constructed of rotational molded plastic such as polyethylene filled with polystyrene foam. The leg assembly comprises a vertically disposed square tube having upper and lower ends and first, second, third and fourth side walls. A table top is secured to the upper end of the vertically disposed tube by a pair of brackets. First, second, third and fourth tubes, having upper and lower ends, are secured at their upper ends to the first, second, third and fourth side walls of the vertically disposed tube, respectively. Preferably, two of the oppositely disposed tubes are welded to the lower end of the vertically disposed tube with the other two oppositely disposed tubes being detachably secured to the vertically disposed tube so that the leg assembly may be broken down into component parts suitable for shipment. First, second, third and fourth seat supports, having upper and lower ends, are secured at their lower ends to the lower ends of the first, second, third and fourth tubes, respectively, and extend upwardly therefrom. A seat member is secured to the upper end of each of the seat supports by a pair of brackets.

It is therefore a principal object of the invention to provide an improved picnic table.

Still another object of the invention is to provide a picnic table which may be conveniently shipped in an unassembled fashion from the manufacturing facility to the point of use where it is assembled.

Still another object of the invention is to provide a picnic table which is easily assembled.

Still another object of the invention is to provide a picnic table which is refined in appearance and durable in use.

These and other objects will be apparent to those skilled in the art.

DESCRIPTION OF THE PREFERRED EMBODIMENT

Figure 1:
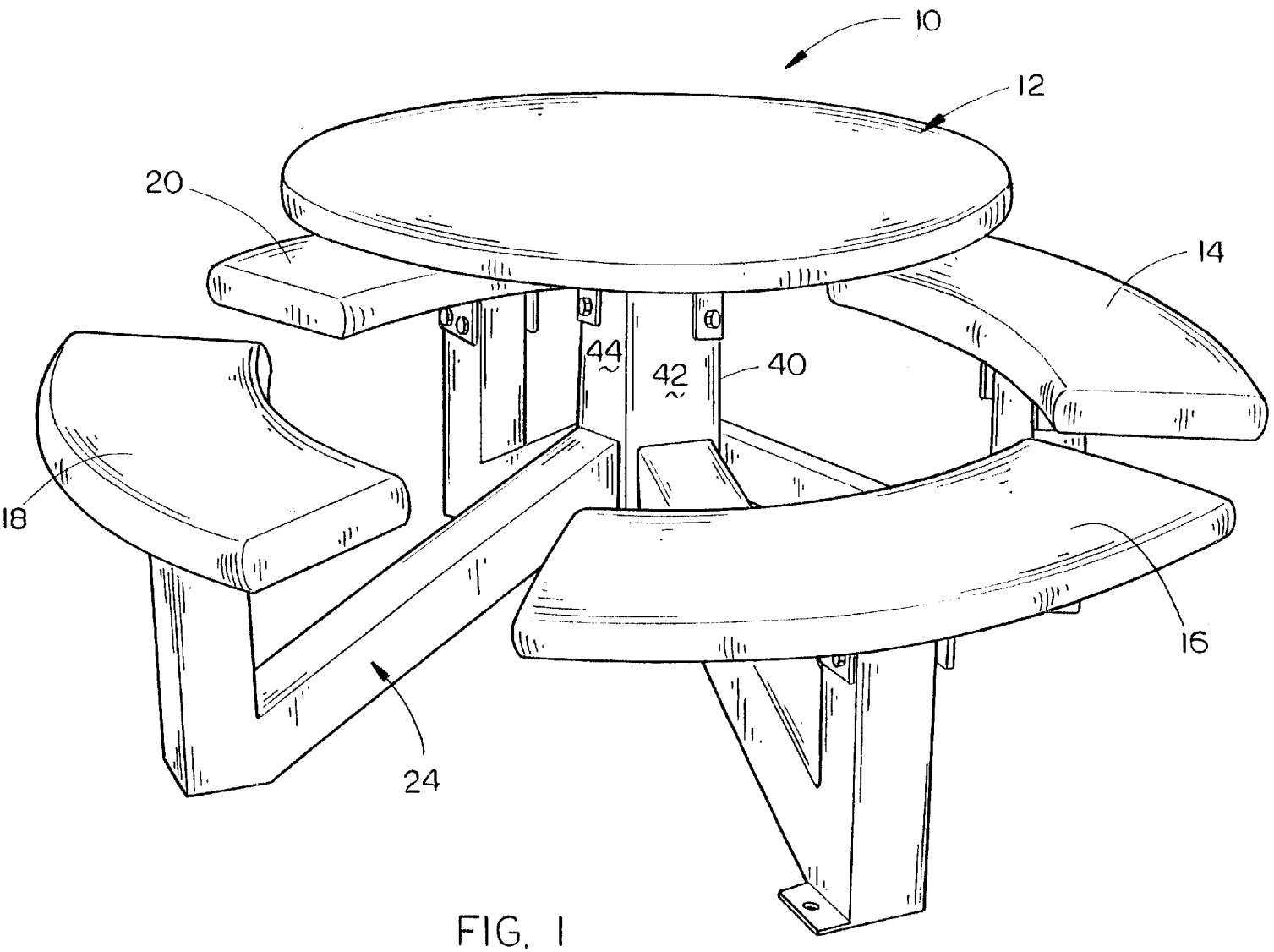
FIG. 1 is a perspective view of the assembled picnic table.

The picnic table of this invention is referred to generally by the reference numeral 10 and generally comprises a table top 12, a plurality of seat members 14, 16, 18 and 20, and a leg structure referred to generally by the reference numeral 24.

Figure 2:
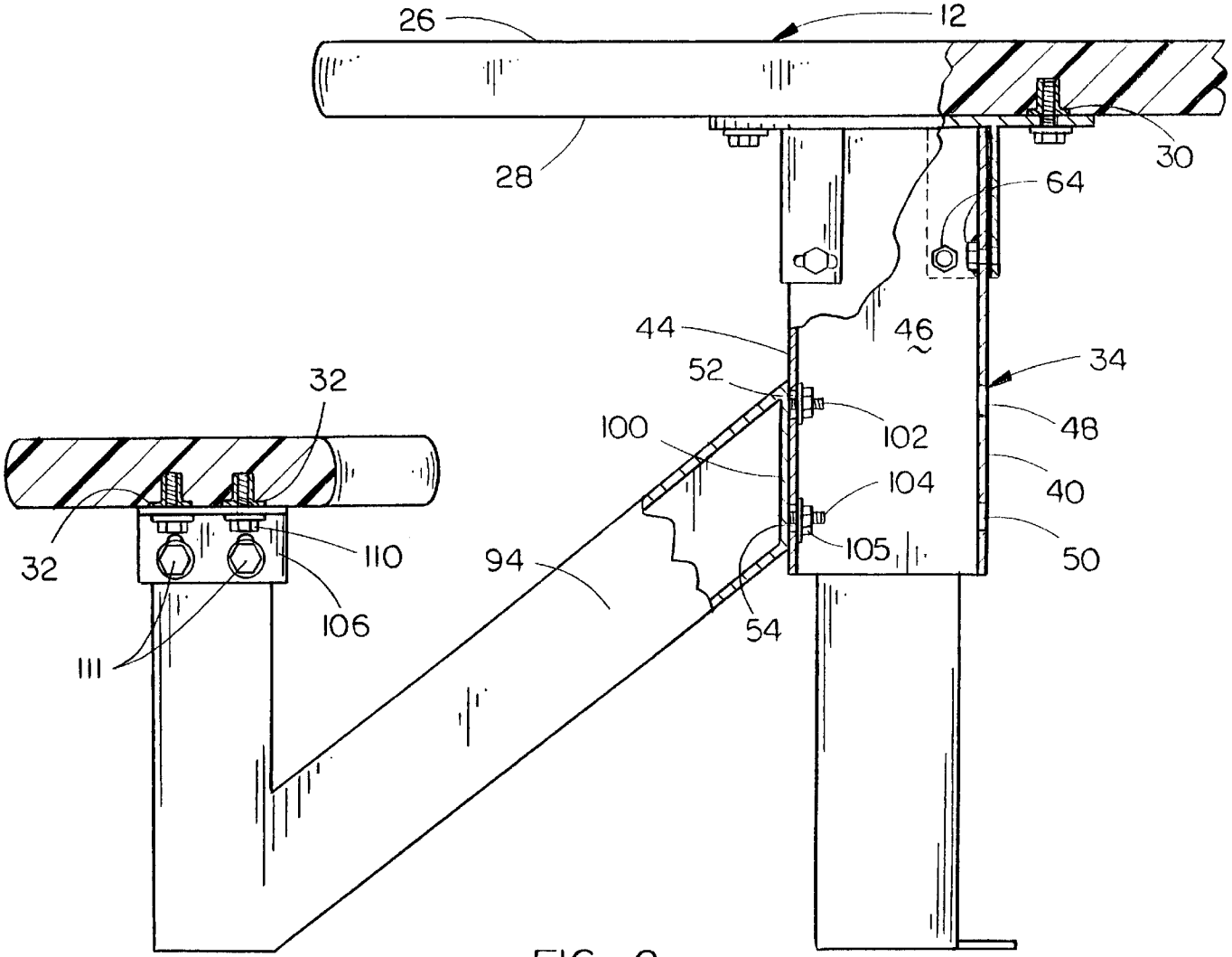
FIG. 2 is a partial vertical sectional view of the picnic table.
Figure 3:
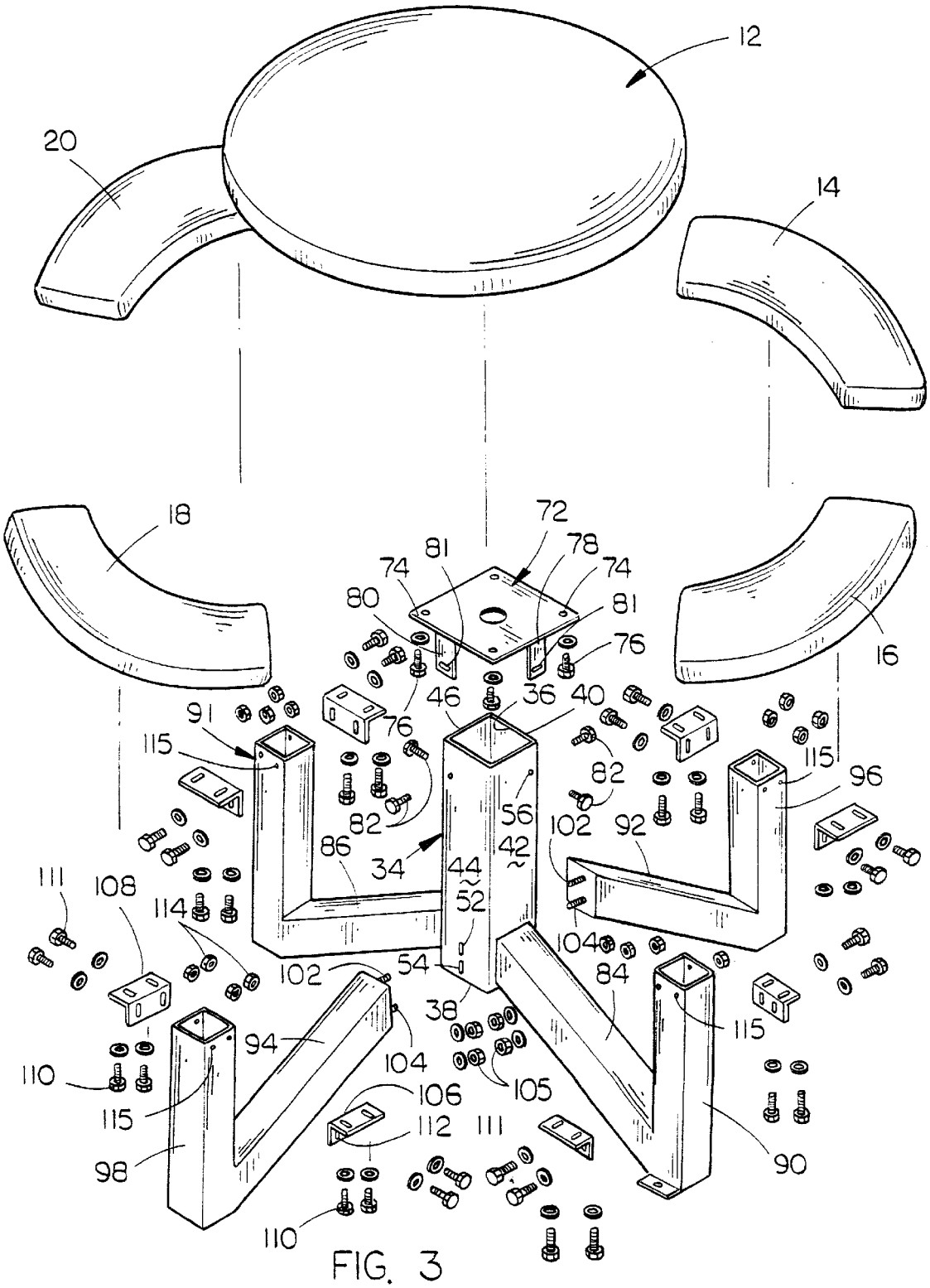
FIG. 3 is an exploded perspective view of the picnic table.

Table top 12 is preferably constructed of a rotational molded polyethylene filled with polystyrene foam to give it weight and solidness (FIG. 2). The table top 12 could also be constructed of a fiberglass reinforced plastic if desired. For purposes of description, table top 12 will be described as having an upper surface 26 and a lower surface 28. As seen in FIG. 2, a plurality of internally threaded nuts 30 are embedded in the bottom surface of table top 12 for a purpose to be described hereinafter. Each of the seat members 14, 16, 18 and 20 also have a plurality of nuts 32 embedded therein for a purpose to be described in more detail hereinafter.

The leg assembly or structure 24 includes a vertically disposed square tube 34 having an upper end 36 and a lower end 38. Although it is preferred that the tube 34 have a square cross-sectional configuration, it is possible that other cross-sectional configurations could also be utilized. Tube 34 includes side walls 40, 42, 44 and 46. The lower end of side wall 40 is provided with a pair of elongated bolt openings 48 and 50 while the lower end of side wall 44 is provided with a pair of elongated openings 52 and 54 formed therein. The upper ends of side walls 40 and 42 each have an opening 56 formed therein while the upper ends of side walls 44 and 46 each have an opening 60 formed therein. Nuts 64 are welded to the interior surfaces of the walls of the tube 34 so as to be in communication with the two openings 56 and the two openings 60, respectively.

A flat plate 72 having openings 74 formed therein is secured to the underside or lower surface 28 of table top 12 by means of bolts 76 extending upwardly through the openings 74 and being threadably received by the nuts 30 which are embedded in the table top 12. A pair of angle members 78 and 80 are welded to the underside of plate 72 and have a pair of elongated openings 81 formed therein adapted to receive bolts 82 extending therethrough which are threadably received by one of the nuts 64 to secure the plate 72 to the upper end of the square tube 34. The elongated nature of the openings 81 through which the bolts 82 extend provides some adjustment means to facilitate the attachment of the plate 72 to the tube 34.

The numerals 84 and 86 refer to hollow square tubes which are welded to side walls 42 and 46, respectively, of tube 34 and which extend downwardly and outwardly therefrom. Seat supports 90 and 91, in the form of hollow tubes, are secured to the outer ends of the tubes 84 and 86, respectively, by welding and extend upwardly therefrom. Tubes 92 and 94 have their upper ends detachably secured to side walls 40 and 44 of square tube 34 and extend downwardly and outwardly therefrom. Seat support members 96 and 98, in the form of hollow square tubes, are secured to the outer ends of tubes 92 and 94 by welding and extend upwardly therefrom.

Each of the tubes 92 and 94 has a flat plate 100 inserted into the lower ends thereof and welded thereto with the plate 100 having a pair of bolts 102 and 104 welded thereto which extend horizontally outwardly therefrom for reception by the openings 48, 50, 52 and 54 in the lower end of tube 34. Nuts 105 are threadably mounted on the inner ends of the bolts 102 and 104 on each of the tubes 92 and 94 to detachably secure the tubes 92 and 94 to the square tube 34. Each of the seat members 14, 16, 18 and 20 has a pair of angle brackets 106 and 108 secured thereto by means of bolts 110 extending upwardly therethrough into the nuts 32. Brackets 106 and 108 are secured to the upper ends of the tubes 88, 90, 96 and 98 by means of bolts 111 extending through openings 112 formed in the brackets 106 and 108 and being threadably received by nuts 114 welded to the interior surface of each of the tubes 90, 91, 96 and 98 inwardly of openings 115 formed therein so that the bolts may be inserted through the openings in the brackets and through openings in the tubes for reception by the nuts 114.

Thus it can be seen that the picnic table of this invention is not only easily assembled, but may be broken down into component parts for shipment.

Thus it can be seen that the invention accomplishes at least all of its stated objectives.

I claim:

1. A picnic table, comprising:

a leg assembly including:

(a) a centrally positioned and vertically disposed hollow, square tube having upper and lower ends, and first, second, third and fourth side walls;

(b) a first tube, having upper and lower ends, secured at its upper end to said first side wall and extending downwardly and outwardly therefrom;

(c) a second tube, having upper and lower ends, secured at its upper end to said second side wall and extending downwardly and outwardly therefrom;

(d) a third tube, having upper and lower ends, secured at its upper end to said third side wall and extending downwardly and outwardly therefrom;

(e) a fourth tube, having upper and lower ends, secured at its upper end to said fourth side wall and extending downwardly and outwardly therefrom;

a seat assembly operatively secured to said leg assembly including:

(a) a first seat support member, having upper and lower ends, secured at its lower end to said lower end of said first tube and extending upwardly therefrom;

(b) a second seat support member, having upper and lower ends, secured at its lower end to said lower end of said second tube and extending upwardly therefrom;

(c) a third seat support member, having upper and lower ends, secured at its lower end to said lower end of said third tube and extending upwardly therefrom;

(d) a fourth seat support member, having upper and lower ends, secured at its lower end to said lower end of said fourth tube and extending upwardly therefrom;

a seat member secured to the upper ends of said first, second, third and fourth seat support members;

and a horizontally disposed table top, having upper and lower surfaces, secured to said upper end of said vertically disposed square tube.

2. The picnic table of claim 1 wherein said vertically disposed tube, said first, second, third and fourth tubes and said first, second, third and fourth seat support members are comprised of a metal material.

3. The picnic table of claim 2 wherein said upper ends of said first and third tubes are welded to said vertically disposed tube and wherein said upper ends of said second and fourth tubes are selectively removably secured to said vertically disposed tube.

4. The picnic table of claim 3 wherein a seat member is selectively removably secured to the upper end of each of said first, second, third and fourth seat support members.

5. The picnic table of claim 4 wherein said table top is selectively removably secured to said vertically disposed tube.

6. The picnic table of claim 5 wherein said seat members and said table top are comprised of a plastic material.

7. The picnic table of claim 2 wherein said first, second, third and fourth tubes are square tubes and wherein said first, second, third and fourth seat support members are square tubes.

8. The picnic table of claim 2 wherein said upper ends of said second and fourth tubes are bolted to said vertically disposed tube.

9. The picnic table of claim 8 wherein the upper ends of each of said second and fourth tubes have a pair of spaced-apart, horizontally extending bolt members secured thereto which are received by bolt openings formed in said vertically disposed tube, and wherein a nut is threadably mounted on each of said bolt members in the interior of said vertically disposed tube.

10. The picnic table of claim 9 wherein said bolt openings are elongated and have their longitudinal axes thereof substantially vertically disposed.

11. The picnic table of claim 2 wherein a flat plate is secured to the upper end of said vertically disposed tube, said flat plate having a plurality of bolt openings formed therein, said table top having a plurality of nuts embedded in its lower surface, and bolt members extending upwardly through said flat plate and being threadably received by said nuts in said lower surface of said table top.

12. The picnic table of claim 11 wherein said flat plate is bolted to said vertically disposed tube.

13. The picnic table of claim 2 wherein a pair of spaced-apart brackets are secured to each of said seat members and wherein each pair of said brackets are bolted to one of said seat support members.

14. The picnic table of claim 13 wherein each of said seat members has an upper surface and a lower surface, and wherein a plurality of nuts are embedded in the lower surface of each of said seat members to permit said brackets to be bolted thereto.

15. The picnic table of claim 1 wherein the upper ends of said first, second, third and fourth tubes are secured to said vertically disposed tube adjacent the lower end thereof.

* * * * *